United States Patent [19]

Ikenoue et al.

[11] 4,237,215

[45] Dec. 2, 1980

[54] HEAT-DEVELOPABLE LIGHT-SENSITIVE MATERIAL

[75] Inventors: Shinpei Ikenoue; Takao Masuda, both of Asaki, Japan

[73] Assignee: Fuji Photo Film Co., Ltd., Minami-ashigara, Japan

[21] Appl. No.: 898,043

[22] Filed: Apr. 20, 1978

Related U.S. Application Data

[63] Continuation of Ser. No. 522,963, Nov. 11, 1974, abandoned.

[30] Foreign Application Priority Data

Feb. 19, 1974 [JP] Japan ..... 49/19760
Nov. 9, 1974 [JP] Japan ..... 49/126658

[51] Int. Cl.[2] ..... G03C 1/02
[52] U.S. Cl. ..... 430/619; 430/349; 430/353; 430/599; 430/620; 430/935
[58] Field of Search ..... 96/114.1, 48 HD, 114.6, 96/94 R, 107, 109, 67

[56] References Cited

U.S. PATENT DOCUMENTS

| | | | |
|---|---|---|---|
| 3,017,271 | 1/1962 | Piper | 96/109 |
| 3,707,377 | 12/1972 | Tiers et al. | 96/114.1 |
| 3,764,329 | 10/1973 | Lee | 96/67 |
| 3,877,940 | 4/1975 | Ericson | 96/48 HD |
| 3,957,491 | 4/1976 | Ohi et al. | 96/109 |

FOREIGN PATENT DOCUMENTS

| | | | |
|---|---|---|---|
| 2402161 | 7/1974 | Fed. Rep. of Germany | 96/114.1 |

*Primary Examiner*—J. Travis Brown
*Attorney, Agent, or Firm*—Sughrue, Rothwell, Mion, Zinn and Macpeak

[57] ABSTRACT

A heat-developable light-sensitive material comprising on a support at least one layer containing (a) an organic silver salt; (b) a light-sensitive silver halide; (c) a reducing agent; and (d) a binder; wherein the light-sensitive silver halide component (b) comprises the reaction product obtained by decomposing an N-halo compound in the presence of the organic silver salt (a) for reaction with the organic silver salt (a) before applying the layer on the support and an embodiment includes a heat-developable light-sensitive material in which the N-halo compound is decomposed in the presence of an alcohol to form the light-sensitive silver halide component (b).

33 Claims, No Drawings

HEAT-DEVELOPABLE LIGHT-SENSITIVE MATERIAL

This is a continuation of application Ser. No. 522,963, filed Nov. 11, 1974, now abandoned.

BACKGROUND OF THE INVENTION

1. Field of the Invention

This invention relates to a heat-developable light-sensitive material.

2. Description of the Prior Art

A photographic process using silver halides is the most commonly used photographic process, since this process is superior to the electrophotographic process or diazo-photographic process in photographic properties such as sensitivity and gradation. However, the silver halide light-sensitive material used in this process is imagewise exposed, developed with a developer and, furthermore, subjected to several processings such as stopping, fixing, water washing and stabilizing so as to prevent the developed image from discoloring or fading and the non-developed area (which will hereinafter be referred to as "background") from blackening. Thus the photographic process using silver halides has the disadvantages that much time and labor are required for the processing, the handling of chemicals is harmful to the human body and the processing rooms and the hands and clothes of the workers are stained. Therefore, it has been very desirable to improve the photographic processing using silver halides so that the processing can be carried out under dry conditions without using solutions and the processed image is maintained stable. To this end, many efforts have been made.

A first approach is the so-called one bath developing and fixing method whereby the two operations of developing and fixing in the silver halide photographic process of the prior art are combined in one bath, as disclosed, for example, in U.S. Pat. No. 2,875,048, British Pat. No. 945,453 and German Pat. No. 1,163,142. A second approach is to conduct the wet processings in the silver halide photographic process in a dry manner, as disclosed, for example, in German Pat. No. 1,174,159 and British Pat. Nos. 943,476 and 951,644. A third approach is to use a light-sensitive element comprising a silver salt of a long chain aliphatic carboxylic acid such as silver behenate, silver saccharin or silver benzotriazole, as a main component, and a catalytic amount of silver halide as disclosed, for example, in U.S. Pat. Nos. 3,152,904, 3,457,075, 3,635,719, 3,645,739 and 3,756,829 and Canadian Pat. No, 811,677. The present invention relates to the third approach.

In heat-developable light-sensitive materials, which have hitherto been proposed, for example, a composition comprising a silver salt of a fatty acid such as silver behenate, a reducing agent and a catalytic amount of silver halide, the properties of the light-sensitive material, such as sensitivity, gamma, fog and color tone deteriorate sometimes after the passage of time due to their insufficient storability. This is a very important disadvantage for a light-sensitive material.

A light-sensitive material containing a light-sensitive silver halide obtained by reacting a halide and an organic silver salt is disclosed in U.S. Pat. No. 3,457,075, but a heat-developable light-sensitive material containing a light-sensitive silver halide thus formed in a catalytic amount provides only a low contrast image. However, a high contrast heat-developable light-sensitive material is required for the purpose of copying documents as well as making films for printing plates and, accordingly, a low contrast heat-developable light-sensitive material cannot be used for this purpose. Furthermore, the heat-developable light-sensitive material of the prior art has the disadvantage that heat fog tends to occur in the non-exposed area upon heating during developing. A previous attempt to prevent formation of this heat fog is, for example, described in U.S. Pat. No. 3,589,903, which is characterized by the use of a compound capable of releasing mercury ion. However, mercury compounds are so harmful that the production or use of a light-sensitive material containing mercury compounds in hazardous. Therefore, the technique described in U.S. Pat. No. 3,589,903 can suppress the heat fog, but, on the other hand, has the disadvantage that a high hazard is unavoidable.

SUMMARY OF THE INVENTION

An object of the invention is to provide a heat-developable light-sensitive material excellent in original storage property.

Another object of the invention is to provide a heat-developable light-sensitive material capable of providing a high contrast image.

A further object of the invention to provide a heat-developable light-sensitive material in which the occurrence of heat fog during heat development is reduced.

Efforts have been made to accomplish the above described objects and consequently the present invention has been developed. That is to say, in accordance with the present invention, there is provided a heat-developable light-sensitive material comprising a support having thereon at least one layer containing (a) an organic silver salt, (b) a silver halide, (c) a reducing agent and (d) a binder, in which the silver halide of component (b) is formed by thermally decomposing an N-halo compound in the presence of the organic silver salt component (a) and optionally, in the presence of an alcohol, for reaction with the organic silver salt component (a) before the layer is provided on the support.

DETAILED DESCRIPTION OF THE INVENTION

When an N-halo compound such as N-bromosuccinimide is incorporated in a light-sensitive material as disclosed in U.S. Pat. No. 3,707,377, the occurrence of heat fog is reduced generally, while, on the contrary, the sensitivity is also reduced markedly.

However, it has now been surprisingly found that the above described three objects can be accomplished without reducing the sensitivity by decomposing an N-halo compound thermally in the presence of an organic silver salt, and optionally in the presence of an alcohol, before coating the heat-developable light-sensitive layer.

Typical N-halo compounds suitable for the invention are the compounds represented by the following general formulas (I) and (II):

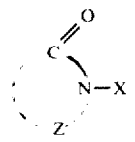

(I)

-continued

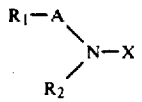

(II)

In these general formulas (I) and (II), X is a halogen atom preferably a chlorine, bromine or iodine atom. Z represents an atomic group necessary for forming a 5-membered ring or 6-membered ring which can be condensed with another ring. Examples of suitable 5-membered rings and 6-membered rings are pyrrole, pyrroline, pyrrolidine, imidazole, imidazoline, imidazolidine, pyrazole, pyrazoline, pyrazolidine, triazole, tetrazole, piperidine, oxazine, thiazine, piperazine (these previously described rings can contain an oxo group or a thiooxo group, and also can include rings where aromatic rings are combined with the above ring through a phenylene group, etc.), hydantoin, cyanuric, thiohydantoin, hexahydrotriazine, indole, indoline, isoindole, benzoimidazole, carbazole and phenoxazine rings. A particularly preferred ring is a pyrrolidine ring. These rings can also be substituted with alkyl groups, aryl groups, alkoxy groups, halogen atoms, oxygen atoms and sulfur atoms. Suitable alkyl groups are those having 1 to about 12 carbon atoms, preferably 1 to 8 carbon atoms, for example, methyl, ethyl, propyl, isopropyl, butyl, isobutyl, t-butyl, pentyl, hexyl, 2-ethylhexyl, octyl, nonyl, decyl and dodecyl groups. Suitable aryl groups are preferably a phenyl group and a naphthyl group, which can be substituted with one or more of alkyl groups having 1 to 4 carbon atoms, such as methyl, ethyl, propyl, isopropyl, butyl and t-butyl groups, and halogen atoms such as chlorine, bromine and iodine. Suitable alkoxy groups are preferably those having 1 to about 12 carbon atoms, more particularly 1 to 8 carbon atoms, such as methoxy, ethoxy, propoxy, isopropoxy, butoxy, t-butoxy, pentoxy, hexoxy, octoxy and dodecoxy groups. A represents a carbonyl group or a sulfonyl group. $R_1$ and $R_2$ each represents an alkyl group, an aryl group or an alkoxy group, the alkyl group and the alkoxy group being preferably those having 1 to about 12 carbon atoms, more preferably 1 to 8 carbon atoms, and the aryl group being preferably a naphthyl group or a phenyl group, which can be substituted with one or more of the above described groups. $R_2$ can also represent a hydrogen atom. The halogenated melamines are N-halo compounds also suitable for the present invention.

Typical examples of N-halo compounds suitable for the invention are as follows.

(1) N-Bromosuccinimide
(2) N-Bromotetrafluorosuccinimide
(3) N-Bromophthalimide
(4) N-Bromoglutarimide
(5) 1-Bromo-3,5,5'-trimethyl-2,4-imidazolidinedione
(6) 1,3-Dibromo-5,5-dimethyl-2,4-imidazolidinedione
(7) N,N'-Dibromo-5,5-diethylbarbituric acid
(8) N,N'-Dibromobarbituric acid
(9) N-Bromoisocyanuric acid
(10) N-Bromoacetamide
(11) N-Bromochloroacetamide
(12) N-Bromotrifluoroacetamide
(13) N-Bromoacetanilide
(14) N-Bromobenzenesulfonylanilide
(15) N-Bromobenzamide
(16) N-Bromobenzenesulfonylamide
(17) N-Bromo-N-benzenesulfonylbenzenesulfonylamide
(18) N-Bromophthalazone
(19) N-Chlorosuccinimide
(20) N-Iodosuccinimide
(21) Trichloroisocyanuric acid
(22) N-Chlorophthalimide
(23) 1,3-Dichloro-5,5-dimethyl-2,4-imidazolidinedione
(24) 3-Chloro-5,5-dimethyl-2,4-imidazolidinedione
(25) 1,3-Diiodo-5,5-dimethyl-2,4-imidazolidinedione
(26) Trichloromelamine
(27) Tribromomelamine
(28) N-Bromocyclohexanedicarbonimide
(29) 1-Bromo-3,5,5-triethyl-2,4-imidazolidinedione
(30) 1-Bromo-3-ethyl-5,5-dimethyl-2,4-imidazolidinedione
(31) 1,3-Dibromo-5,5-diethyl-2,4-imidazolidinedione
(32) N,N-Dibromo-5,5-dimethylbarbituric acid
(33) N,N-Dibromo-5-ethyl-5-methylbarbituric acid
(34) N,N-Dibromo-5-ethyl-5-phenylbarbituric acid
(35) N,N'-Dibormoisocyanuric acid
(36) N-Bromoacetamide
(37) N-Bromonaphthamide
(38) N-Bromohydroxybenzamide
(39) N-Bromocarboxybenzamide
(40) N-Bromotoluenesulfonamide
(41) N-Bromo-N-toluenesulfonyltoluenesulfonylamide
(42) 1-Bromo-3,3,5-trimethyl-2,4-imidazolidinedithione
(43) 1-Bromo-3,5,5-triethyl-2,4-imidazolidinedithione
(44) 1-Bromo-3-ethyl-5,5-dimethyl-2,4-imidazolidinedithione
(45) 1,3-Dibromo-5,5-dimethyl-2,4-imidazolidinedithione
(46) 1,3-Dibromo-5,5-diethyl-2,4-imidazolidinedithione
(47) 1,3-Dichloro-5,5-dimethyl-2,4-imidazolidinedithione
(48) 3-Chloro-5,5-dimethyl-2,4-imidazolidinedithione
(49) 1,3-Diiodo-5,5-dimethyl-2,4-imidazolidinedithione
(50) N-Bromosaccharin
(51) N,N-Dibromo-5,5-dimethyl-2,4,6-pyrimidinetrione
(52) N,N-Dibromo-2,4,6-trioxypyrimidine The N-halo compound component (e) and the organic silver salt component (a) can be mixed in any form. In order to contact the N-halo compound and the organic silver salt thoroughly the N-halo compound preferably is added to a dispersion of the organic silver salt in a suitable solvent such as ethanol, methanol, isopropanol, toluene, benzene, cyclohexane, water, isoamyl acetate, etc. followed by mixing. A mixing method in which an N-halo compound is added to an organic silver salt dispersed in a polymer solution is also preferred. The N-halo compounds can be used individually or as a combination of two or more.

In a preferred embodiment, it has been found that an alcohol is particularly effective as a compound capable of serving to release the halide ion of the N-halo compound. The term "alcohol" as used herein designates an alcohol in a broad sense. In particular, a primary alcohol or secondary alcohol is suitable for the present invention. An alcohol which is liquid at a low temperature (about 30° C.) is preferred. In particular, an aliphatic alcohol having 1 to 8 carbon atoms, an alicyclic alcohol having 5 to 10 carbon atoms, an aromatic alcohol having 7 to 12 carbon atoms and a heterocyclic alcohol having 5 to 10 carbon atoms are suitable for the invention.

The alcohol of the invention can contain atoms other than carbon atoms and hydrogen atoms, for example, nitrogen atoms and oxygen atoms.

Examples of alcohols suitable for use in the invention are methanol, ethanol, n-propanol, isopropanol, 1-butanol, 1-heptanol, 1-octanol, β-phenylethyl alcohol, furfuryl alcohol, pyridylcarbinol, 2-octanol, α-phenylethyl alcohol, pyridylethyl alcohol, cyclohexanol, allyl alcohol, benzyl alcohol, isobutyl alcohol, sec-butyl alcohol, crotyl alcohol, and cyclopentanol.

Two or more alcohols can be used in combination if desired. The alcohol can be present in combination with water or solvents other than alcohols. The ratio of the N-halo compound and the alcohol can be varied over a wide range but generally the N-halo compound/alcohol molar ratio ranges between about 1:1 to $1:10^6$, preferably 1:10 to $1:10^4$.

As described above, the N-halo compound and an alcohol can be mixed in any manner. The N-halo compound can be added to an organic silver salt dispersed in an alcohol such as ethanol, methanol, isopropanol, sec-butyl alcohol or 2-octanol. Furthermore, an N-halo compound and an alcohol can be added to an organic silver salt dispersed in another solvent, for example, toluene, benzene, cyclohexane or isoamyl acetate, and thus the N-halo compound is decomposed. In this case, the N-halo compound and the alcohol can be added simultaneously or separately. Preferably, the N-halo compound and the alcohol are mixed with an organic silver salt dispersed in a polymer solution. When the polymer is in the form of an alcoholic solution, it is not necessary to add additional alcohol. An optional mixing order of the three components (organc silver salt, alcohol and N-halo compound) can be used. The addition speed can freely be determined. In some cases, the N-halo compound can be incrementally added.

The N-halo compound is heated and decomposed in the presence of an organic silver salt, and in addition a silver halide previously formed can also be present. The N-halo compound can be decomposed at any suitable temperature. A higher temperature is desirable for accelerating the decomposition of the N-halo compound, but, on the other hand, a problem results in that the solvent vaporizes vigorously and the organic silver salt solidifies, and appropriate measures to compensate for these problems should be taken. In general, the N-halo compound is preferably decomposed at about 80° C. or lower. As the temperature becomes lower, the decomposition speed of the N-halo is reduced. However, a mixture of an organic silver salt and silver halide is obtained which produces little heat fog during heat development. The lower limit of the temperature is not particularly limited, but, in general, a temperature of about 0° C. or higher is desirable for decomposing the N-halo compound. Desirable decomposing temperatures range from 30° C. to 65° C., more preferably from 40° C. to 55° C., since less heat fog in the obtained heat-developable light-sensitive material is achieved and less time for decomposing the N-halo compound is required. The decomposing period is preferably more than 15 minutes, particularly more than 30 minutes. The decomposing period generally used is about 15 hours or less, particularly 3 hours or less. An N-halo compound also can firstly be decomposed at a high temperature, for example, 60° C. and then at a low temperature, for example, 20° C., and vice versa.

If the decomposition of the N-halo compound is insufficient, the sensitivity and contrast are reduced as disclosed in U.S. Pat. No. 3,707,377 and Japanese Pat. No. 45,228/1973. If the N-halocompound is decomposed sufficiently, however, a heat-developable light-sensitive material is obtained with a high sensitivity, high contrast, little heat fog and excellent original storage property.

The thermal decomposition of the N-halo compound in the presence of the organic silver salt can be carried out at any point in time before the composition comprising the organic silver salt and the N-halo compound is coated onto a support, but, in the case of incorporating a sensitizing dye in the above described composition, it is preferably carried out before the sensitizing dye is incorporated in the composition, because the N-halo compound, being an oxidant, adversely infuences the sensitizing dye. The degree of decomposition of the N-halo compound can be determined by determining whether or not a dye such as a merocyanine dye, for example, as shown by the following is oxidized and decolored.

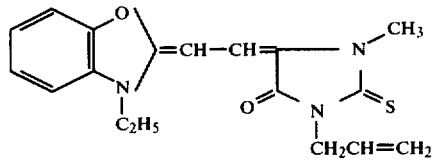

That is to say, it is preferable that the N-halo compound is decomposed to a sufficient extent that the red color of the above described merocyanine dye does not fade even when the merocyanine dye is added in a proportion of $5\times10^{-3}$ mol per 1 mol of the N-halo compound.

Where the above described merocyanine dye is decomposed, only a low sensitivity heat-developable light-sensitive material is obtained since color sensitization thereof with a merocyanine dye or cyanine dye is impossible. In another case where the N-halo compound is decomposed until the above described merocyanine dye is not decolored, on the contrary, a heat-developable light-sensitive material with a high sensitivity, high contrast and little heat fog can be obtained.

The quantity of the N-halo compound employed is preferably about 0.1 to 30 mole %, particularly about 0.5 to 20 mole %, based on the total quantity of silver. If the quantity of the N-halo compound is too low, the original storage property and heat fog resistance are not increased as much, while, if the quantity is too high, the back-ground tends to color after the light-sensitive material is processed to form an image and allowed to stand under normal room illumination. Of the N-halo compounds used in the invention, the N-bromo compounds are particularly preferable because of their excellent sensitivity and color tone. Furthermore, the compounds represented by the foregoing general formula (I) are more preferable in the present invention. Two or more of the above described N-halo compounds can be used in combination if desired. The sensitivity can be further increased by the combined use of an N-bromo compound with an N-iodo compound or an N-chloro compound. Where the amount of the N-bromo compound is 30 mole % or higher of the N-halo compounds, the sensitivity is markedly increased. For example, the combined use of an N-bromo compound and an N-iodo compound, an N-bromo compound and an N-chloro compound or an N-bromo compound, an N-chloro compound and an N-iodo compound is preferred. For example, where the N-bromo compound is present in an amount of higher than about 30 mol %, a suitable amount of the N-iodo compound and the N-chloro compound is less than about 50 mol %, where the N-bromo compound is present in an amount of higher than about 40 mol %, a suitable amount of the N-chloro compound is less than about 60 mol %, and where the N-bromo compound is present in an amount higher than about 50 mol %, a suitable amount of the N-iodo compound is less than about 50 mol %.

The heat-developable light-sensitive material of the invention is generally produced by preparing a dispersion of an organic silver salt and silver halide dispersed in a polymer solution, adding thereto additives such as reducing agents, color toning agents and sensitizing dyes and coating onto a support followed by drying. As described above, the decomposition of the N-halo compound is preferably carried out before the coating or more preferably before the addition of a sensitizing dye, if employed, in the above described steps.

The organic silver salt of the component (a) used in the invention is a substantially uncolored silver salt that is relatively stable to light and capable of providing a silver image through reaction with a reducing agent upon heating at 80° C. or higher, preferably 110° C. or higher in the presence of a silver halide.

The organic silver salt used as the component (a) in the invention can be a silver salt of an organic compound having an imino group, a hydroxyl group, a mercapto group or a carboxyl group. Silver salts of aliphatic carboxylic acids having 10 or more carbon atoms are particularly preferred in the invention.

Specific examples of the organic silver salts are as follows:

(1) silver salts of organic compounds containing an imino group:

For example, silver benzotriazole, silver nitrobenzotriazole, silver alkyl-substituted benzotriazoles such as silver methylbenzotriazole, silver halogen-substituted benzotriazoles such as silver bromobenzotriazole, silver aminobenzotriazoles, silver carboimide-substituted benzotriazole such as

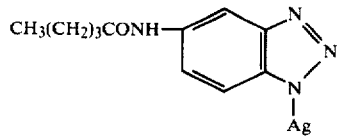

or

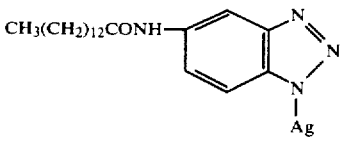

silver saccharin, silver phthaliazinone, silver substituted-phthalazinones, silver carbazole and silver benzimidazole, (2) silver salts of organic compounds containing a mercapto group:

For example, silver salts of 3-mercapto-4-phenyl-1,2,4-triazole, 2-mercapto-benzimidazole, 2-mercapto-5-aminothiadiazole, 1-phenyl-5-mercaptotetrazole, 2-mercaptobenzothiazole and 2-(S-ethylthioglycolamide)benzothiazole, (3) silver salts of organic compounds containing a hydroxyl group:

For example, silver salt of 4-hydroxy-6-methyl-1,3,3a,7-tetrazaindene, (4) silver salts of organic compounds containing a carboxyl group:

For example, silver salts of higher fatty acids such as silver caprate, silver laurate, silver myristate, silver palmitate, silver stearate and silver behenate, silver salts of dicarboxylic acids such as silver adipate, silver sebacate, silver maleate, silver fumarate, silver tartarate and silver linolate, and silver salts of aromatic carboxylic acids such as silver benzoate, silver 3,5-dihydroxybenzoate, silver o-methylbenzoate, silver m-methylbenzoate, silver p-methylbenzoate, silver 2,4-dichlorobenzoate, silver gallate, silver tannate, silver phthalate, silver terephthalate and silver salicylate.

Preparation of the organic silver salt is generally carried out by mixing a solution of a silver salt forming organic compound dissolved in a suitable solvent and an aqueous solution of a silver salt such as silver nitrate or silver complex salt. For example, a methanol solution of benzotriazole and an aqueous solution of silver nitrate are mixed to react the benzotriazole and silver nitrate to form silver benzotriazole. As disclosed in Japanese Pat. No. 30270/1969, moreover, silver nitrate dissolved in a Solvent A which is capable of dissolving silver nitrate and nitric acid but which dissolves silver benzotriazole with difficulty, for example, water, dimethylformamide or dimethyl sulfoxide, and benzotriazole dissolved in a Solvent B which is capable of dissolving benzotriazole but which does not dissolve or only slightly dissolves silver benzotriazole and silver nitrate, and in which the above described Solvent A has a solubility of about 1 to 30% by weight based on the total liquid quantity (Solvent A+Solvent B), for example, phosphoric acid esters, phthalic acid esters and dibasic fatty acid esters of alcohols and phenols, and higher fatty acid glycerin esters, such as tricresyl phosphate, dimethoxyethyl phthalate, di-n-butyl phthalate, diethyl sebacate, monooctyl dibutyl phosphate, tributyl phosphate, castor oil and linseed oil, are mixed to react the silver nitrate and the benzotriazole. Similar methods can also be applied to other organic silver salts in many cases.

A method of preparing an organic silver salt suitable for organic silver carboxylates such as silver laurate, silver caprate, silver myristate, silver palmitate, silver stearate, silver behenate, silver adipate and silver sebacate comprises preparing a silver salt by mixing an aqueous solution of silver nitrate and an aqueous solution of a water soluble carboxylic acid salt, for example, the alkali metal salt such as the sodium, potassium or lithium salt, and the ammonium salt. In addition a method of preparing a silver salt of an organic carboxylic acid by mixing an organic carboxylic acid dissolved in a solvent capable of dissolving organic carboxylic acids but dissolving only slightly silver salts of organic carboxylic acids and silver nitrate, and being less soluble in water, for example, phosphoric acid esters such as tricresyl phosphate, tributyl phosphate and mono-octyl dibutyl phosphate, phthalic acid esters such as diethyl phthalate, dibutyl phthalate, dioctyl phthalate and dimethoxyethyl phthalate, carboxylic acid esters such as amyl acetate, isopropyl acetate, isoamyl acetate, ethyl acetate, 2-ethylbutyl acetate, butyl acetate, propyl acetate, dioctyl sebacate, dibutyl sebacate, diethyl sebacate, diethyl succinate, ethyl formate, propyl formate, butyl formate, amyl formate, ethyl valerate, diethyl tartarate, methyl butyrate, ethyl butyrate, butyl butyrate and isoamyl butyrate, higher fatty acid glycerin esters such as castor oil, aromatic hydrocarbons such as benzene, toluene and xylene, and n-hexane and cyclohexane, this solution being optionally emulsified with water or an alkaline aqueous solution, for example, aqueous solutions of sodium hydroxide, potassium hydroxide or ammonia, with an aqueous solution of silver nitrate or a silver complex salt, preferably, an alkali-soluble silver complex salt having a higher dissociation constant than the silver salts of organic carboxylic acids, for example, silver ammine complex salt, silver methylamine complex salt and silver ethylamine complex salt, and a method of preparing a silver salt of organic carboxylic acid by mixing an aqueous solution of a salt of an organic carboxylic acid, for example, the sodium salt, potassium salt or ammonium salt, with an emulsion of a solvent difficultly soluble in water as described above and an aqueous solution of a silver salt such as silver nitrate or a silver complex salt can be used. These methods can also be applied to preparation of other organic silver salts.

These methods of preparing organic silver salts are disclosed in U.S. Pat. No. 3,458,544, Japanese Pat. No. 30270/1969, Japanese patent applications (OPI) Nos. 13224/1974, 11814/1974, 1551/1974"; 93310/1974, 94619/1974, 7619/1973, 9362/1973 and French Pat. No. 2,147,286. The silver salt of an organic carboxylic acid obtained by these methods is particularly desirable because of its low level of heat fog.

The silver halide of the component (b) according to the invention can comprise a silver halide formed by decomposing an N-halo compound in the presence of an organic silver salt alone, in the presence of an organic silver salt and an alcohol or in combination with a silver halide previously formed by another method, for example, as disclosed in Japanese patent application (OPI) No. 17216/1975. Another silver halide can also be present which is formed by the presence of a compound capable of forming a silver halide through reaction with the organic silver salt of component (a). Other methods of forming silver halides are described in U.S. Pat. No. 3,706,564 and No. 3,706,656.

In another more preferable method for forming a light-sensitive silver halide to be used together with the silver halide of the invention, a previously prepared organic silver salt is reacted with a light-sensitive silver halide forming component (hereinafter illustrated) to convert a part of the organic silver salt into a catalytic amount of silver halide. This method is described in, for example, U.S. Pat. No. 3,152,904 and Japanese patent application (OPI) No. 78316/1975. The method of the invention relates to an improvement of this method.

A further method for forming a light-sensitive silver halide used together with the silver halide of the invention consists in preparing previously a silver halide and then mixing this with an organic silver salt, as disclosed in, for example, Japanese Pat. No. 82852/1973, Japanese patent applications (OPI) Nos. 32928/1975 9332/1972 and No. 9179/1972, Belgian Pat. No. 774,436, French Pat. No. 2,107,162 and No. 2,078,586 and U.S. Pat. No. 3,706,564.

As the silver halide forming component, any compounds capable of forming a silver halide through reaction with an organic silver salt can be used. Which silver halide forming component is suitable can be readily determined, for example, by reacting a silver halide forming component with an organic silver salt and examining the diffraction peak characteristics of the silver halide by X-ray diffraction.

Suitable compounds capable of reacting with an organic silver salt to form a silver halide are, for example, inorganic compounds represented by the general formula:

$$MX_n$$

in which M represents a hydrogen atom, an ammonium group or a metal atom such as strontium, cadmium, zinc, tin, chromium, sodium, barium, iron, cesium, lanthanum, copper, calcium, nickel, magnesium, potassium, rubidium, aluminum, antimony, gold, cobalt, lead, beryllium, manganese, mercury, germanium, gallium, indium, rhodium, ruthenium, palladium, iridium, platinum, molybdenum, tungsten, osmium, or bismuth, X represents a halogen atom such as chlorine, bromine or iodine and n represents 1 when M represents a hydrogen atom or an ammonium group and the valency of M when M represents a metal atom. Other examples of silver halide forming components are halogen-containing metal complexes such as $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $K_3RhCl_6$ and $(NH_4)_3RhCl_6$. Organic halogen compounds such as onium halides described in U.S. Pat. No. 3,679,422 can also be suitably used. Specific examples of onium halides are onium halides such as cetylethyldimethylammonium bromide and trimethylbenzylammonium bromide. Other examples of the silver halide forming components are halogenated hydrocarbons such as iodoform, bromoform and carbon tetrabromide and other halogen-containing compounds such as triphenylmethyl chloride, triphenylmethyl bromide, 2-bromo-2-methylpropane, 2-bromobutyric acid, 2-bromoethanol and dichlorobenzophenone.

The above described light-sensitive silver halide forming components can be used alone or as a combination of two or more. The quantity thereof is generally about 0.001 to 0.5 mol, preferably 0.005 to 0.2 mol per mol of the organic silver salt component (a). If less than about 0.001 mol per mol of the organic silver salt component (a) is employed the sensitivity is reduced, while, if more than about 0.5 mol per mole of the organic silver salt component (a) is used, the light discoloration increases and the contrast between the image areas and the background areas decreases. The light discoloration described herein means that, when a heat-developed material is allowed to stand under normal room illumination, the non-image area (background area) discolors gradually. For example, where a silver halide forming component other than the N-halo compound of this invention is additionally present, a suitable proportion of the N-halo compound in the combination is preferably bout 50 mol % up to 100 mol %, more preferably 80 mol % up to 100 mol %, to the silver halide component (b).

The silver halide used in the invention can be sensitized with, forexample, reducing agents, sulfur or selenium compounds, gold, platinum or palladium compounds, or combinations thereof, which are generally used as chemical sensitizers for silver halides. Suitable methods are, for example, described in U.S. Pat. Nos. 2,623,499, 2,399,083, 3,297,447 and No. 3,297,446.

The reducing agent component (c) according to the invention must be a compound capable of reducing the organic silver salt (a) and forming a silver image when heated in the presence of the exposed silver halide catalyst. A suitable reducing agent, depending on the combination with an organic silver salt, is generally chosen from substituted phenols, substituted or unsubstituted bisphenols, substituted or unsubstituted mono-or bisnaphthols, di- or polyhydroxybenzenes, di- or polyhydroxynaphthalenes, hydroquinone monoethers, ascorbic acid or its derivatives, 3-pyrazolidones, pyrazoline-5-ones, reducing saccharides, phenylene diamines or its derivatives, amino-reductions, kojic acid and hinokitiol. Examples of these reducing agents are described in Japanese Pat. No. 41865/1971, Japanese patent applications (OPI) No. 36110/1975 and 115540/1975, Canadian Pat. No. 811,677, U.S. Pat. Nos. 3,679,426, 3,152,904, 3,457,075, 3,531,286 and No. 3,589,903, Japanese patent applications (OPI) No. 1238/1972 and No. 10282/1972, Belgian Pat. No. 786,086, and German Pat. OLS No. 2,031,748 and No. 2,120,958.

Specific examples of reducing agents are as follows:

(1) Substituted phenols:

p-Aminophenol, o-aminophenol, N-methyl-p-aminophenol, 2-methoxy-4-aminophenol, 2,4-diaminophenol, 2-β-hydroxyethyl-4-aminophenol, p-t-butylphenol, p-t-amylphenol, p-cresol, p-acetophenol, 2,6-di-t-butyl-p-cresol, p-phenylphenol, p-ethylphenol, p-sec-butylphenol, o-phenylphenol, 1,4-dimethoxyphenol, p-acetoacetyl-4-methylphenol, 2,3-dimethylphenol, 3,4-xylenol, 2,4-xylenol, 2,6-dimethoxyphenol, 2,4,5-trimethylphenol, 2,4-di-t-butylphenol, 3,5-di-t-butyl-4-hydroxybenzyldimethylamine, chlorothymol, α-phenol-o-cresol, p-nonylphenol, p-octylphenol, etc.

(2) Substituted or unsubstituted bisphenols:

Bisphenol A, 1,1-bis(2-hydroxy-3,5-dimethylphenyl)-3,5,5-trimethylhexane, 2,4,4-trimethylphenyl-bis(2-hydroxy-3,5-dimethylphenyl)methane, bis(2-hydroxy-3-t-butyl-5-methylphenyl)methane, bis(2-hydroxy-3,5-di-t-butylphenyl)methane, 4,4'-methylenebis(3-methyl-5-t-butylphenol), 4,4'-methylenebis(2,6-di-t-butylphenol), 2,2'-methylenebis(2-t-butyl-4-ethylphenol), 2,6-methylenebis(2-hydroxy-3-t-butyl-5-methylphenyl), 4-methylphenol, 3,3',5,5'-tetra-t-butyl-4,4'-dihydroxybiphenyl, 1,1-bis(4-hydroxyphenyl)-cyclohexane, 1,1-bis(5-chloro-2-hydroxyphenyl)methane, 2,2-bis-(3,5-dibromo-4-hydroxyphenyl)propane, 2,2-bis(4-hydroxyphenyl)-propane, 2,2-bis(3,5-dimethyl-4-hydroxyphenyl)propane, 2,2-bis-(3-methyl-4-hydroxyphenyl)propane, bis(3-methyl-4-hydroxy-5-t-butylphenyl)sulfide, α,α'-(3,5-di-t-butyl-4-hydroxyphenyl)-dimethyl ether, N,N-di(4-hydroxyphenyl)urea, diethylstilbestrol, hexestrol, etc.

(3) Substituted or unsubstituted mono- or bisnaphthols and di- or polyhydroxynaphthalenes:

Sodium 1-amino-2-naphthol-6-sulfonate, 1-naphthylamine-7-sulfonic acid, 1-hydroxy-4-methoxynaphthalene, 1-hydroxy-4-ethoxynaphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxynaphthalene, β-naphthol, α-naphthal, 1,1'-dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, etc.

(4) Di- or polyhydroxybenzenes and hydroquinone monoethers:

Hydroquinone, methylhydroquinone, chlorohydroquinone, bromohydroquinone, phenylhydroquinone, hydroquinonemonosulfonate, t-octylhydroquinone, t-butylhydroquinone, 2,5-dimethylhydroquinone, 2,6-dimethylhydroquinone, methoxyhydroquinone, ethoxyhydroquinone, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether, hydroquinone mono-n-hexyl ether, methyl gallate, propyl gallate, etc.

(5) Ascorbic acid or its derivatives and other photodecomposable reducing agents:

1-Ascorbic acid, isoascorbic acid, ascorbic acid monoesters such as ascorbic acid monolaurate, monomyristate, monopalmitate, monostearate and monobehenate, ascorbic acid diesters such as ascorbic acid dilaurate, dimyristate, dipalmitate and distearate, furoin, benzoin, dihydroxyacetone, glyceraldehyde, rhodizonic acid-tetrahydroxyquinone, etc.

(6) 3-Pyrazolidones and pyrazolones:

1-Phenyl-3-pyrazolidone, 4-methyl-4-hydroxymethyl-1-phenyl-3-pyrazolidone, 1-(2-quinoline)-3-methyl-5-pyrazolone, etc.

(7) Reducing saccharides and others:

Glucose, lactose, p-oxyphenylglycine, hydroxytetronic acid, N,N-di(2-ethoxyethyl)hydroxylamine, N,N-dialkyl-p-phenylenediamines, N,N-dibenzylidene-p-phenylenediamine, 5,7-dihydroxy-4-methylcoumarin, kojic acid, hinokithiol, etc.

These reducing agents can be used alone or as a combination of two or more. A suitable reducing agent is selected depending on the organic silver salt with which it is combined. A relatively strong reducing agent, for example, a bisphenol such as 4,4'-methylenebis(3-methyl-5-t-butylphenol) is suitable for a silver salt of higher fatty acid which is relatively difficult to reduce, for example, silver behenate, while a relatively weak reducing agent, for example, a substituted phenol such as p-phenylphenol is suitable for a silver salt which is relatively easy to reduce, for example, silver laurate. A strong reducing agent, for example, ascorbic acid is suitable for a silver salt which is very hard to reduce.

The quantity of a reducing agent as described above varies widely with the kinds of an organic silver salt, the reducing agent used, the presence of additives such as color toning agents, but, in general, is preferably about 0.1 to 5 mols per 1 mol of the organic silver salt.

As is apparent from the above description, in order to prepare the heat-developable light-sensitive material of the invention, a suitable reducing agent can be selected and combined with a specific organic silver salt and it is not necessary to specify particularly which organic silver salt is preferred or which reducing agent is preferred.

An important additive in combination with the reducing agent is a color toning agent. This color toning agent is often added, in particular, when it is required to obtain an image having a black color tone. The most general color toning agent is phthalazinone or its substituted derivatives. One substituted phthalazinone is represented by the general formula,

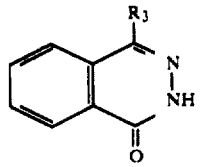

in which $R_3$ represents a monovalent substituent selected from the group consisting of alkyl groups having 4 or less carbon atoms, alkoxy groups having 4 or less carbon atoms, halogen atoms, hydroxyalkyl groups having 4 or less carbon atoms, phenyl group, phenyl groups substituted with at least one substituent selected from the group consisting of halogen atoms, alkyl groups having 4 or less carbon atoms, amino groups and alkyl-substituted amino groups, 1-naphthyl groups, 2-naphthyl groups, benzylidenehydrazino groups, aminoalkyl groups having 4 or less carbon atoms, morpholinoalkyl groups having an alkyl moiety of 4 or less carbon atoms, pyridyl groups, β-styryl groups, vinyl groups and 2-substituted vinyl groups.

Examples of the above described compounds include 4-methylphthalazinone, 4-phenylphthalazinone, 4-(1-naphthyl)phthalazinone, 4-(2-naphthyl)phthalazinone, 4-hydroxymethylphthalazinone, 4-chlorophthalazinone, 4-(p-chlorophenyl)phthalazinone, 4-(p-pyridino)phthalazinone, 4-methoxyphthalazinone, 4-β-styrylphthalazinone, 4-dimethylaminomethylphthalazinone, 4-morpholinomethylphthalazinone, 4-(p-methoxybenzyl)phthalazinone, 4-(benzylidenehydrazino)phthalazinone, 4-(p-dimethylaminophenyl)phthalazinone and 4-benzylphthalazinone.

Another substituted phthalazinone is represented by the general formula,

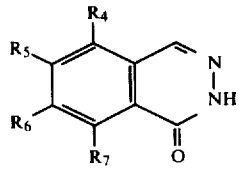

in which $R_4$, $R_5$, $R_6$ and $R_7$, which may be same or different, each represents monovalent substituents selected from the group consisting of hydrogen atoms, halogen atoms, alkyl groups having 4 or less carbon atoms, alkoxy groups having 4 or less carbon atoms, nitro groups, amino groups and hydroxyl groups, at least one of $R_4$, $R_5$, $R_6$ and $R_7$ not being a hydrogen atom.

Examples of the above described compounds are 6-chlorophthalazinone, 5,7-dimethoxyphthalazinone, 8-methylphthalazinone, 6-bromophthalazinone, 8-t-butylphthalazinone, 5-nitrophthalazinone, 8-aminophthalazinone, and 8-hydroxyphthalazinone.

Other known effective color toning agents are known phthalimides, oxazinones, pyrazoline-5-ones, quinazolines and mercapto compounds as described in Japanese Patent Applications (OPI) 5020/1974, 5019/1974 and 2523/1975, and German Pat. OLS Nos. 2,140,406, 2,141,063, and 2,120,958.

The quantity of a color toning agent used generally is in the range of about 0.0001 to 2 mols, preferably 0.0005 to 1 mol per 1 mol of the organic silver salt component (a).

In the present invention, the components (a), (b) and (c) and a color toning agent and a sensitizing dye, if present, are preferably dispersed in a binder (d) and applied to a support. The application can be carried out by coating all of the components (a), (b) and (c) dispersed in a binder (d) onto a support as one layer or by coating the components dispersed separately in a binder (d) onto a support layers. As component (d), any binders conventionally used in this field can be employed. A hydrohobic binder is preferably used but a hydrophilic binder can also be used. These binders are transparent or semitransparent natural materials such as gelatin, gelatin derivatives, mixtures of gelatin or gelatin derivatives with vinyl type polymer latexes and cellulose derivatives as well as synthetic polymeric materials.

Specific examples of binders are gelatin, phthalated gelatin, acrylamide, polyvinyl butyral, cellulose acetate butyrate, cellulose acetate propionate, polymethyl methacrylate, polyvinyl pyrrolidone, polystyrene, ethyl cellulose, polyvinyl chloride, chlorinated rubbers, polyisobutylene, butadiene-styrene copolymers, vinyl acetate—vinyl chloride copolymers, vinyl acetate—vinyl chloride—maleic acid copolymers, polyvinyl alcohol, polyvinyl acetate, benzyl cellulose, cellulose acetate, cellulose propionate and cellulose acetate phthalate. As the occasion demands, mixtures of two or more of these compounds can be used. The quantity of the binder is preferably about 10:1 to 1:10 by weight, more preferably 4:1 to 1:4 by weight, to the organic silver salt (a). When component (a) or (c) is a high molecular weight material acting also as a binder, the binder (d) can be omitted.

The support of the invention can be selected from a wide variety of materials. Typical examples of supports are cellulose nitrate films, cellulose ester films, poly(vinylacetal) films, polystyrene films, poly(ethylene terephthalate) films, polycarbonate films, glass sheets, paper and metallic sheets. In the case of a paper support, it is desirable to incorporate clay or styrene butadiene rubber in the support.

The quantity of the above described binder dispersion coated on a support is preferably about 0.2 to 3 $g/m^2$, particularly 0.4 to 2 $g/m^2$, as silver. If less than about 0.2 $g/m^2$ is employed, a sufficient image density cannot be attained, while, if more than about 3 $g/m^2$ is employed, the cost rises.

An antistatic layer or an electrically conductive layer can be employed in the heat-developable light-sensitive material in the invention. However, an antihalation material and antihalation dye can be incorporated therein, if desired.

If desired, a matting agent such as starch, titanium dioxide, zinc oxide or silica can be incorporated in the heat-developable light-sensitive material. Furthermore, a fluorescent brightening agent such as a stilbene, a triazine, a oxazole or a coumarin, can be incorporated in the heat-developable light-sensitive material.

Some optical sensitizing dyes suitable for sensitizing silver halide emulsions can be advantageously used for providing enhanced sensitivity to the heat-developable light-sensitive material of the invention. For example, the optical sensitization can be carried out by adding a sensitizing dye in the form of a solution or dispersion in an organic solvent. Examples of suitable sensitizers which can be used are cyanines, merocyanines, rhodacyanines, styryl dyes and acidic dyes such as erythrosine, eosine and fluorescein. Merocyanine dyes containing a carboxyl group, a carboxyalkyl group or a carboxyaryl group are particularly preferable because of their high sensitization efficiency. The quantity of such a dye is about $10^{-6}$ mol to $10^{-2}$ mol per 1 mol of the organic silver salt component (a).

The heat-developable light-sensitive layer of the invention can be coated on a support using various coating methods, for example, an immersion method, a air knife method, a curtain coating method and an extrusion method using a hopper as described in U.S. Pat. No. 2,681,294. If desired, two or more layers can be coated at the same time. If desired, moreover, a top-coating polymer layer can be provided on the light-sensitive layer so as to increase the transparency of the heat-developable light-sensitive layer, increase the image density and improve the original storage property (the ability of the light-sensitive material to maintain on storage the photographic properties the material has immediately after the production thereof). The thickness of this top-coating polymer layer is preferably about 1 to 20 microns.

Suitable polymers which can be used for the top-coating polymer layer are, for example, polyvinyl chloride, polyvinyl acetate, copolymers of vinyl chloride and vinyl acetate, polyvinyl butyral, polystyrene, polymethyl methacrylate, polyurethane, xylene resins, benzyl cellulose, ethyl cellulose, cellulose acetate butyrate, cellulose acetate, polyvinylidene chloride, chlorinated polypropylene, polyvinylpyrrolidone, cellulose propionate, polyvinyl formal, cellulose acetate phthalate, polycarbonate and cellulose acetate propionate.

When silica or kaolin is incorporated in the top-coating polymer layer, writing with a pencil or a ball-point pen after image formation becomes possible. In addition, heat fog is decreased and the degree of whiteness is increased by incorporating therein a fatty acid having 10 or more carbon atoms such as lauric acid, myristic acid, palmitic acid, stearic acid, and behenic acid. Furthermore, an ultraviolet absorber or higher fatty acid can be incorporated in the finishing polymer layer. In addition, a phenolic coupler or color coupler having an active methylene group can be used together with a p-phenylenediamine as a reducing agent so as to form a color image, as described in Japanese Pat. No. 7782/1971. Acids, for example, higher fatty acids and benzenesulfonic acid are preferably incorporated as a stabilizer. Suitable examples are described in Japanese Patent Applications (OPI) Nos. 125016/1974 and 57619/1975. Benzotriazole and its derivatives and 1-phenyl-5-mercaptotetrazole can be added as a stabilizer.

The above described heat-developable light-sensitive material can be developed by heating merely after it is exposed, e.g., for about $10^{-12}$ to about 10 seconds, preferably $10^{-9}$ to 10 seconds, to light from a light source such as a xenon lamp, a tungsten lamp or a mercury lamp. A suitable heating temperature is generally about 80° to 180° C., preferably 110° to 150° C. A higher temperature or lower temperature can be employed within this range by appropriately lengthening or shortening the heating time. The developing time is generally about 1 to 60 seconds.

In the heat-developable light-sensitive layer, furthermore, other additives, for example, mercury salts and can be incorporated in order to prevent heat fog (unfavourable fog occurring when a non-exposed area is heated). These additives are disclosed in U.S. Pat. No. 3,589,903.

The heating and developing of the light-sensitive material of the invention, for example, can be by contacting the exposed material with a simple heated plate or with a heated drum and, in some cases, it can be passed through a heated space. The heating can be carried out using high frequency or a laser beam.

The following examples are given in order to illustrate the invention in greater detail. Unless otherwise indicated, all parts, percents, ratios and the like are by weight.

EXAMPLE 1

1.9 g of sodium hydroxide was dissolved in 200 ml of water. 12 g of lauric acid dissolved in 100 ml of toluene was added thereto, stirred with a stirrer and emulsified. On stirring at 800 rpm for 5 minutes, a solution of 8.5 g of silver nitrate in 50 ml of water was added for a period of 60 seconds to prepare silver laurate. The silver laurate crystals were removed dispersed in 30 g of polyvinyl butyral and 200 ml of isopropyl alcohol in a ball mill to thus prepare a polymer dispersion of the silver salt. This is designated "Liquid A".

6 ml of a 1.4 weight % methanol solution of Compound (1) was added to 50 g of the above described polymer dispersion of the silver salt and stirred at 50° C. for 90 minutes. This is designated "Liquid B". The following Composition (I) was added to 25 g of Liquid B to prepare a heat-developable light-sensitive composition and coated onto a support (coated paper) in a silver quantity of 0.4 g per 1 $m^2$ of the support, thus producing a heat-developable Light-Sensitive Material (B).

| Composition (I) | |
|---|---|
| Dye* (0.025 weight % methyl Cellosolve solution) | 2 ml |
| Phthalazinone (3 weight % methanol solution) | 4 ml |
| p-Phenylphenol (20 weight % acetone solution) | 5 ml |

For comparison, 25 g of Liquid A was mixed with the following Composition (II) and a heat-developable Light-Sensitive Material (A-1) was prepared in an analogous manner to the above.

| Composition (II) | |
|---|---|
| Hydrogen Bromide (0.5 weight % methanol solution) | 4 ml |
| Dye* (0.025 weight % methyl Cellosolve solution) | 2 ml |
| Phthalazinone (3 weight % methanol solution) | 4 ml |
| p-Phenylphenol (20 weight % acetone solution) | 5 ml |

For comparison, 25 g of Liquid A was mixed at 15° C. with the following Composition (III) and a heat-developable Light-Sensitive Material (A-2) was prepared in an analogous manner to the above.

| Composition (III) | |
|---|---|
| Compound (1) (1.4 weight % methanol solution) | 3 ml |
| Dye* (0.025 weight % methyl Cellosolve solution) | 2 ml |
| Phthalazinone (3 weight methanol solution) | 4 ml |

-continued

| Composition (III) | |
|---|---|
| p-Phenylphenol (20 weight % acetone solution) | 5 ml |

*The dye had the following structure

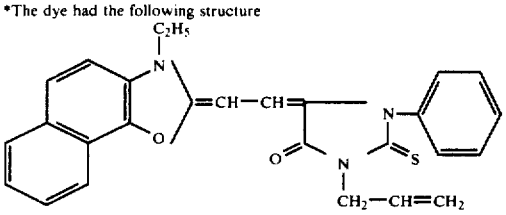

These Light-Sensitive Materials (A-1), (A-2) and (B) were subjected to an exposure of $10^5$ lux.sec using a tungsten lamp as a light source through an optical wedge, heated and developed at 120° C. for 40 seconds and the reflection density of the resulting image was measured. The reciprocal of the exposure quantity necessary to provide a reflection density of 0.1 higher than fog was selected as the standard of sensitivity. When the sensitivity of Light-Sensitive Material (A-1) was assumed to 100, the relative sensitivity, heat fog density and γ of the characteristic curve obtained are tabulated below:

| | Light-Sensitive Material | | |
|---|---|---|---|
| | (A-1) | (A-2) | (B) |
| Sensitivity | 100 | 3 | 140 |
| γ | 0.6 | 0.5 | 2.5 |
| Heat Fog | 0.31 | 0.24 | 0.18 |

As is evident from the results in this table, Light-Sensitive Material (B) of the present invention shows superior properties in sensitivity, gradation and heat fog.

After Light-Sensitive Materials (A-1) and (B) were allowed to stand in a relative humidity of 50–60% at a temperature of 25° C. for 1 month, images were formed under similar conditions to the above, followed by sensitometry. In Light-Sensitive Material (A-1), the heat fog increased remarkably, the sensitivity was greatly reduced, the maximum image density reduced greatly and the color tone changed from black to yellow, while, on the contrary, Light-Sensitive Material (B) showed scarcely any change in photographic properties.

That is to say, it is apparent that Light-Sensitive Material (B) was also superior in original storage property.

When Light-Sensitive Material (A-2) was heated at 120° C. for 15 seconds and exposed under similar conditions to the above, followed by sensitometry, on the other hand, the sensitivity was 4 when the sensitivity of Light-Sensitive Material (A-1) was 100, and the γ was 0.6.

It is apparent that in order to obtain a light-sensitive material having a high γ and a high sensitivity it is necessary to heat and decompose the N-halo compound, such as Compound (1), before coating.

EXAMPLE 2

5 ml of a 1.1 weight % methanol solution of Compound (3) in place of Compound (1) used in Example 1 was added to 50 g of Liquid A as described in Example 1 and stirred at 40° C. for 180 minutes. This is designated "Liquid C".

25 g of Liquid C was mixed with the following Composition (IV) to prepare a heat-developable light-sensitive composition and then coated onto a support paper in a silver quantity of 0.4 g per 1 $m^2$ of the support, thus producing a heat-developable Light-Sensitive Material (C).

| Composition (IV) | |
|---|---|
| Dye* (0.025 weight % methyl Cellosolve solution) | 2 ml |
| Phthalazinone (3 weight % methanol solution) | 8 ml |
| Reducing Agent** (20 weight % acetone solution) | 5 ml |

*The dye had the following structure

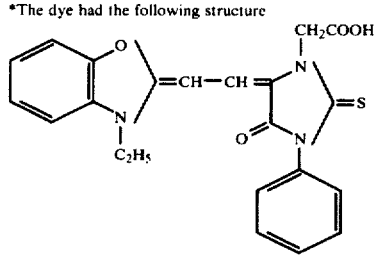

**The reducing agent had the following structure

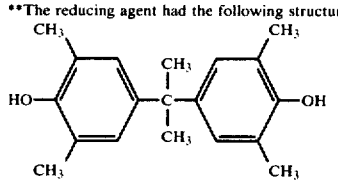

For comparison, 25 g of Liquid A was mixed with the following Composition (V) and a heat-developable Light-Sensitive Material (A-3) was prepared in an analogous manner to the above.

| Composition (V) | |
|---|---|
| Hydrogen Bromide (0.5 weight % methanol solution) | 3 ml |
| Dye (0.025 weight % methyl Cellosolve solution) (same as dye of Composition (IV) | 2 ml |
| Phthalazinone (3 weight % methanol solution) | 8 ml |
| Reducing Agent (20 weight % acetone solution) (same as the reducing agent of Composition (IV)) | 5 ml |

These Light-Sensitive Materials (A-3) and (C) were exposed under similar conditions to Example 1, developed at 120° C. for 30 seconds and subjected to sensitometry.

When the sensitivity of Light-Sensitive Material (A-3) was assumed to be 100, the relative sensitivity, γ and heat fog density are tabulated below:

| | Light-Sensitive Material | |
|---|---|---|
| | (A-3) | (C) |
| Sensitivity | 100 | 110 |
| γ | 0.8 | 3.5 |
| Heat Fog*** | 0.48 | 0.28 |

***Since the reducing agent was different from that of Example 1, the fog density increased overall.

It is apparent from the results in this table that Light-Sensitive Material (C) is superior.

EXAMPLE 3

3 ml of a 1.2 weight % methanol solution of Compound (6) in place of Compound (1) used in Example 1 was added to 50 g of Liquid A prepared as described in Example 1 and stirred at 60° C. for 30 minutes. This was designated "Liquid D".

25 g of Liquid D was mixed with Composition (IV) of Example 2 and coated under similar conditions to Example 2 to prepare a heat-developable Light-Sensitive Material (D).

The resulting light-sensitive material was processed under similar conditions to Example 2 and subjected to sensitometry, and the results as shown in the following table were obtained.

| Sensitivity* | γ | Fog |
|---|---|---|
| 105 | 3.7 | 0.31 |

*Relative Sensitivity when the sensitivity of Light-Sensitive Material (A-3) = 100

EXAMPLE 4

6 ml of a 1.4 weight % methanol solution of Compound (1) and 2 ml of a 0.18 weight % methanol solution of Compound (20) in place of Compound (1) used in Example 1 were added to 50 g of Liquid A of Example 1 and stirred at 50° C. for 90 minutes. This was designated "Liquid E".

To 25 g of this Liquid E was added the following Composition (VI) and a heat-developable Light-Sensitive Material (E) was prepared in an analogous manner to Example 1.

| Composition (VI) | |
|---|---|
| Dye* (0.025 weight % methanol solution) | 3 ml |
| Phthalazinone (3 weight % methanol solution) | 8 ml |
| Reducing Agent** (20 weight % acetone solution) | 5 ml |

*Dye: 2',7'-dichlorofluorescein
**Reducing Agent: same as described in Example 2

For comparison, the following Composition (VII) was added to 25 g of Liquid A of Example 1 and a heat-developable Light-Sensitive Material (A-4) was prepared under similar conditions to Example 1.

| Composition (VII) | |
|---|---|
| Hydrogen Bromide (0.5 weight of methanol solution) | 3 ml |
| Dye (0.025 weight % methanol solution) (same as that of Composition (VI)) | 3 ml |
| Phthalazinone (3 weight % methanol solution) | 8 ml |
| Reducing Agent (20 weight % acetone solution) (same as that of Composition (VI)) | 5 ml |

These Light-Sensitive Materials (A-4) and (E) were processed under similar conditions to Example 2 and subjected to sensitometry and the results tabulated below were obtained.

| | Light-Sensitive Material | |
|---|---|---|
| | (A-4) | (E) |
| Sensitivity*** | 100 | 980 |
| γ | 0.9 | 3.4 |
| Fog | 0.45 | 0.29 |

***Relative Sensitivity when the sensitivity of Light-Sensitive Material (A-4) = 100

EXAMPLE 5

6 ml of a 0.6 weight % methanol solution of Compound (10) in place of Compound (1) of Example 1 was added to 50 g of Liquid A of Example 1 and heated at 50° C. for 90 minutes. This was designated "Liquid F".

To 25 g of this Liquid F was added Composition (VI) of Example 4 and a heat-developable Light-Sensitive Material (F) was prepared under similar conditions to Example 1. This Light-Sensitive Material (F) was processed under similar conditions to Example 2 and subjected to sensitometry, and the results tabulated below were obtained.

| Sensitivity* | γ | Fog |
|---|---|---|
| 180 | 21 | 0.26 |

*Relative Sensitivity when the sensitivity of Light-Sensitive Material (A-4) = 100

EXAMPLE 6

3.4 g of behenic acid was dissolved in 100 ml of toluene at 60° C. and the temperature of the solution was adjusted to 60° C. The solution was mixed with 100 ml of a dilute aqueous solution of nitric acid having a pH of 2.0 while stirring by means of a stirrer. On stirring with a stirrer and holding at 60° C., to the mixed solution was added an aqueous solution containing a silver ammonium complex salt, i.e., prepared by adding aqueous ammonia to about 80 ml of an aqueous solution containing 1.7 g of silver nitrate to form a silver ammonium complex salt and then adding water to make 100 ml. Thus a dispersion containing fine crystals of silver behenate was obtained. When this dispersion was allowed to stand at room temperature for 20 minutes, it separated into an aqueous phase and toluene phase. The aqueous phase was firstly removed and 400 ml of fresh water was added followed by washing by decantation. This operation was repeated three times and then 400 ml of toluene was added, followed by centrifugal separation to obtain silver behenate. 4 g of silver behenate in the form of spindles having a length of 1 micron and a width of 0.05 micron was obtained.

2.5 g of this silver behenate was added to 60 ml of an isopropyl alcohol solution containing 6 g of polyvinyl butyral and the mixture was ball milled for 1 hour to prepare a polymer dispersion. This was designated "Liquid G".

To 50 g of this polymer dispersion of the silver salt was added 3 ml of a 1 weight % methanol solution of Compound (1) and the mixture was stirred at 65° C. for 90 minutes. This was designated "Liquid H".

The following Composition (VIII) was added to Liquid H to prepare a heat-developable light-sensitive composition and the composition was coated onto a paper support in a silver quantity of 0.6 g per 1 $m^2$ of the support, thus producing a heat-developable Light-Sensitive Material (H).

| Composition (VIII) | |
|---|---|
| Dye* (0.025 Weight % methyl cellosolve solution) | 2 ml |
| 2,2'-Methylene-bis(6-t-butyl-4-methylphenol) (25 weight % methyl cellosolve solution) | 4 ml |
| Phthalazinone (2.5 weight % methyl cellosolve solution) | 5 ml |

For comparison, 25 g of Liquid G was mixed with the following Composition (IX) and a heat-developable light-sensitive material (H) was prepared under similar conditions to the above.

| Composition (IX) | |
|---|---|
| Ammonium bromide (1 weight % methanol solution) | 1 ml |
| Dye* (0.025 weight % methyl cellosolve solution) | 3 ml |
| 2,2'-Methylene-bis(6-t-butyl-4-methylphenol) (25 weight % methyl cellosolve solution) | 4 ml |
| Phthalazinone (2.5 weight % methyl cellosolve solution) | |

*Dye: The same dye as described in Example 1

These Light-Sensitive Materials (H) and (G) were exposed under similar conditions to Example 1, heated and devoloped at 120° C. for 25 seconds and subjected to sensitometry to obtain the results tabulated below:

| | Light-Sensitive Material | |
|---|---|---|
| | (H) | (G) |
| Sensitivity** | 100 | 115 |
| $\gamma$ | 1.5 | 3.2 |
| Fog | 0.38 | 0.24 |

EXAMPLE 7

1.9 g of sodium hydroxide was dissolved in 200 ml. of water. 12 g of lauric acid dissolved in 100 ml of toluene was added thereto, stirred using a stirrer and emusified. After being stirred at 800 rpm for 5 minutes, an aqueous solution of silver nitrate (silver nitrate 8.5 g, water 50 ml) was added over a period of 60 seconds to prepare silver laurate. The thus precipitated silver laurate was removed and divided into two portions. To one portion of the silver laurate were added 15 g of polyvinyl butyral and 100 ml of isopropyl alcohol and the mixture was ball milled to prepare a polymer dispersion of the silver salt (Liquid A). To the other portion of the silver laurate were added 15 g of polyvinyl butyral and 100 ml of toluene and the mixture was ball milled to prepare a polymer dispersion of the silver salt (Liquid L).

6 ml of a 1.4% acetone solution of Compound (1) was added to 50 g of each of these dispersions and stirred at 25° C. for 8 hours to thus prepare Liquid M from Liquid A and Liquid N from Liquid L. The following Composition (X) was added to 25 g of each of Liquids M and N and coated onto a paper support (art paper) in a silver quantity of 0.4 g/m$^2$, thus obtaining heat-developable Light-Sensitive Materials M and N.

COMPARATIVE EXAMPLE 1

Silver laurate was prepared in an analogous manner to Example 1. The precipitated silver laurate was removed and ball milled with 30 g of polyvinyl butyral and 200 ml of acetone to prepare a polymer dispersion. This was designated "Liquid K". To Liquid K was added Composition (III) as described in Example 1 at 2° C. to prepare a heat-developable light-sensitive composition and the composition was coated onto a support paper (coated paper) in a silver quantity of 0.4 g per 1 m$^2$ of the support, thus producing a heat-developable Light-Sensitive Material (K).

When the resulting Light-Sensitive Material (K) was exposed under similar conditions to Example 1 and subjected to sensitometry, no substantial image was obtained. Then Light-Sensitive Material (K) was heated at 120° C. for 20 seconds, exposed under similar conditions to Example 1 and subjected to sensitometry, but only a sensitivity and $\gamma$ image lower than in the case of Light-Sensitive Material (A-2) was obtained.

It is also apparent from this result that it is necessary in order to obtain a light-sensitive material having a high $\gamma$ and a high sensitivity to heat and decompose an N-halo compound such as Compound (1) before coating.

EXAMPLE 7

1.9 g of sodium hydroxide was dissolved in 200 ml of water. 12 g of lauric acid dissolved in 100 ml of toluene was added thereto, stirred using a stirrer and emulsified. After being stirred at 800 rpm for 5 minutes, an aqueous solution of silver nitrate (silver nitrate 8.5 g, water 50 ml) was added over a period of 60 seconds to prepare silver laurate. The thus precipitated silver laurate was removed and divided into two portions. To one portion of the silver laurate were added 15 g of polyvinyl butyral and 100 ml of isopropyl alcohol and the mixture was ball milled to prepare a polymer dispersion of the silver salt (Liquid A). To the other portion of the silver laurate were added 15 g of polyvinyl butyral and 100 ml of toluene and the mixture was ball milled to prepare a polymer dispersion of the silver salt (Liquid L).

6 ml of a 1.4% acetone solution of Compound (1) was added to 50 g of each of these dispersions and stirred at 25° C. for 8 hours to thus prepare Liquid M from Liquid A and Liquid N from Liquid L. The following Composition (X) was added to 25 g of each of Liquids M and N and coated onto a paper support (art paper) in a silver quantity of 0.4 g/m$^2$, thus obtaining heat-developable Light-Sensitive Materials M and N.

| Composition (X) | |
|---|---|
| Dye* (0.025% 2-methoxyethanol solution) | 2 ml |
| Phthalazinone (3% methanol solution) | 7 ml |
| Reducing Agent** (20% acetone solution) | 5 ml |

*Dye

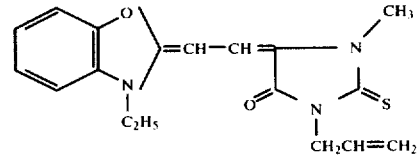

**Reducing Agent

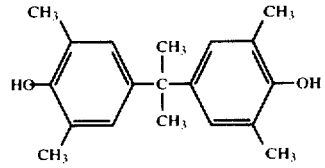

When the dye was added to Liquid N, the red color of the dye decolored and became colorless. When the dye was added to Liquid N, the red color of the dye remained.

For comparison, the following Composition (XI) was added to 25 g of Liquid A and a heat-developable Light-Sensitive Material (A-5) was prepared in an analogous manner to the above mentioned.

| Composition (XI) | |
|---|---|
| Mercuric Bromide (0.2% methanol solution) | 2 ml |
| Hydrogen Bromide (0.5% methanol solution) | 4 ml |
| Dye* (0.025% 2-methoxyethanol solution) | 2 ml |
| Phthalazinone (3% methanol solution) | 7 ml |
| Reducing Agent** (20% acetone solution) | 5 ml |

*Dye and **Reducing Agent: same as those of Composition (X) For comparison, to 25 g of Liquid A was added Composition (XI) from which the mercuric bromide had been removed and a heat-developable light-sensitive Material (A-6) was perpared in an analogous manner to the above. This Light-Sensitive Material (A-6) was exposed under similar conditions to Example 1 and devoloped at 140° C. for 15 seconds, followed by measurement of the reflection density.

When the sensitivity of Light-sensitive Material (A-5) was set as 100, the relative sensitivity, heat fog and γ obtained are tabulated below:

| | Light-Sensitive Material | | | |
|---|---|---|---|---|
| | A-5 | A-6 | M | N |
| Sensitivity | 100 | 85 | 135 | 7 |
| Heat Fog | 0.18 | 0.85 | 0.16 | 0.18 |
| γ (Contrast) | 0.7 | 0.1 | 3.8 | 1.5 |

It is apparent from the results in this table that Light-Sensitive Material M prepared by decomposing Compound (1) in the presence of the alcohol gives a very low heat fog and a high sensitivity and γ.

EXAMPLE 8

Silver laurate was prepared in an analogous manner to Example 7, mixed with 30 g of polyvinyl butyral and 200 ml of ethanol and ball milled to prepare a polymer dispersion of silver salt (Liquid P). 6 ml of a 3% acetone solution of Compound (18) was added to 50 g of this dispersion and stirred at 30° C. for 12 hours to prepare Liquid Q. Composition (IV) of Example 2 was added thereto and the composition coated onto a paper support in a silver quantity of 0.4 g/m$^2$ thus obtaining a heat-developable light-sensitive Material Q. The resulting Light-Sensitive Material Q was exposed under similar conditions to Example 1 and then developed at 120° C. for 30 seconds, followed by sensitometry.

When the sensitivity of Light-Sensitive Material (A-3) is set as 100, the relative sensitivity, γ and heat fog obtained for Light-Sensitive Material Q are tabulated below:

| Sensitivity | γ (Contrast) | Heat Fog |
|---|---|---|
| 109 | 3.8 | 0.15 |

EXAMPLE 9

To 100 g of the polymer dispersion of silver salt (Liquid A) prepared in Example 1 was added 12 ml of a 1.4% acetone solution of Compound (1) (1.2 ml×10 times) over an interval of 10 minutes and the mixture was stirred for 30 minutes to prepare Liquid R. 50 g of Liquid R was removed, mixed with 4 ml of a 3% acetone solution of Compound (18) and stirred at 30° C. for 10 hours to prepare Liquid S. Composition (IV) of Example 2 was added to 25 g of each of Liquids R and S and then the liquids were coated onto a paper support in a silver quantity of 0.4 g Ag/m$^2$ of the support, thus obtaining heat-developable Light-Sensitive Materials R and S.

Light-Sensitive Material (A-3) of Example 2 and Light-Sensitive Materials R and S were exposed under similar conditions to Example 1 and developed at 140° C. for 12 seconds, followed by sensitometry.

When the sensitivity of Light-Sensitive Material (A-3) is set as 100, the sensitivity, γ and heat fog of Light-Sensitive Materials R and S are shown in the following table:

| | Light-Sensitive Material | | |
|---|---|---|---|
| | A-3 | R | S |
| Sensitivity | 100 | 980 | 1100 |
| γ (Contrast) | 0.4 | 3.2 | 3.3 |

-continued

| | Light-Sensitive Material | | |
|---|---|---|---|
| | A-3 | R | S |
| Heat Fog | 0.85 | 0.32 | 0.19 |

example 10

Light-Sensitive Material (A-2) prepared in Example 1 was heated at 120° C. for 15 seconds, then exposed under similar conditions to Example 1 and subjected to sensitometry, resulting in a sensitivity of 4 and γ of 0.6 when the sensitivity of Light-Sensitive Material (A-1) of Example 1 was set as 100. It is apparent from this example that it is preferred in order to obtain a light-sensitive material having a high γ and high sensitivity to decompose the N-halo compound such as Compound (1) in the presence of an alcohol before coating.

While the invention has been described in detail and with reference to specific embodiments thereof, it will be apparent to one skilled in the art that various changes and modifications can be made therein without departing from the spirit and scope thereof.

What is claimed is:

1. In a method of preparing a heat developable light-sensitive material comprising on a support at least one layer containing (a) an organic silver salt; (b) a light-sensitive silver halide; (c) a reducing agent; and (d) a binder; the improvement which comprises increasing the sensitivity of and improving the gradation of said light-sensitive material by decomposing a N-halo compound in the presence of the organic silver salt (a) and an alcohol for reaction with the organic silver salt (a) to produce the light-sensitive silver halide (b) before applying the layer on the support.

2. The method of claim 1, wherein the organic silver salt is a silver salt of an organic compound containing a carboxyl group, a hydroxyl group, and imino group or a mercapto group.

3. The method of claim 1, wherein said N-halo compound comprises the combination of N-iodosuccinimide and one of N-bromosuccinimide, N-bromophthalimide, 1-bromo-3,5,5'-trimethyl-2,4-imidazolidinedione, or 1,3-dibromo-5,5-dimethyl-2,4-imidazolidinedione.

4. The method of claim 1, wherein the N-halo compound is at least one compound represented by General Formula (I)

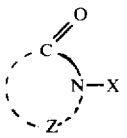

(I)

wherein X represents a halogen atom and Z represents an atomic group necessary for forming a 5-membered ring or a 6-membered ring.

5. The method of claim 4, wherein said N-halo compound is N-bromophthalazone.

6. The method of claim 1, wherein the N-halo compound is at least one compound represented by the General Formula (II)

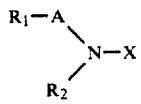

(II)

wherein $R_1$ represents an alkyl group, an aryl group or an alkoxy group, $R_2$ represents a hydrogen atom, an alkyl group, an aryl group or an alkoxy group, A represents a carbonyl group or a sulfonyl group, and X represents a halogen atom.

7. The method of claim 6, wherein said N-halo compound is N-bromosuccinimide.

8. The method of claim 6, wherein said N-halo compound is N-bromophthalimide.

9. The method of claim 6, wherein said N-halo compound is N-bromoacetamide.

10. The method of claim 1, wherein the N-halo compound is at least one halogenated melamine.

11. The method of claim 10, wherein said N-halo compound is 1-bromo-3,5,6'-trimethyl-2,4-imidazolidinedione.

12. The method of claim 10, wherein said N-halo compound is 1,3-dibromo-5,5-dimethyl-2,4-imidazolidinedione.

13. The method of claim 1, wherein the N-halo compound is decomposed until a merocyanine dye in the presence of the N-halo compound is no longer decolored.

14. The method of claim 1, wherein the alcohol is a primary alcohol or a secondary alcohol.

15. The method of claim 14, wherein the alcohol is a liquid at about 30° C.

16. The method of claim 15, wherein the alcohol is an aliphatic alcohol having 1 to 8 carbon atoms, an alicyclic alcohol having 5 to 10 carbon atoms, an aromatic alcohol having 7 to 12 carbon atoms or a heterocyclic alcohol having 5 to 10 carbon atoms.

17. The method of claim 1, wherein the N-halo compound is decomposed at a temperature of about 0° C. to about 80° C.

18. The method of claim 17, wherein the N-halo compound is decomposed at a temperature of 30° C. to 65° C.

19. The method of claim 17, wherein the N-halo compound is decomposed at a temperature of 40° C. to 55° C.

20. The method of claim 19, wherein the N-halo compound is heated and decomposed at 40° C. to 55° C. for 30 minutes to 3 hours in the presence of the organic silver salt (a).

21. The method of claim 1, wherein the N-halo compound is present in a proportion of about 0.1 to 30 mol % based on the total silver quantity.

22. The method of claim 21, wherein said N-halo compound is present in an amount of 0.5 to 20 mol % based on the total silver quantity.

23. The method of claim 1, wherein the N-halo compound is an N-bromo compound.

24. The method of claim 1, wherein said N-halo compound comprises at least about 30 mol % or more of an N-bromo compound.

25. The method of claim 24, including an N-iodo compound an N-chloro compound or a mixture thereof in an amount less than 50 mol %.

26. The method of claim 24, wherein said N-bromo compound is present in an amount of more than 40 mol % and including an N-chloro compound in an amount of less than 60 mole %.

27. The method of claim 24, wherein said N-bromo compound is present in an amount of more than 50 mol % and including an N-iodo compound in an amount of less than 50 mol %.

28. The method of claim 24, wherein said N-halo compound comprises an N-bromo compound and an N-iodo compound.

29. The method of claim 1, further containing a color toning agent.

30. The method of claim 29, wherein the color toning agent is phthalazinone.

31. The method of claim 1, further containing a sensitizing dye.

32. The method of claim 1, wherein the organic silver salt is a silver salt of an aliphatic carboxylic acid having 10 or more carbon atoms.

33. The method of claim 1, wherein said N-halo compound is N-iodosuccinimide and one of N-bromosuccinimide, N-bromophthalimide, N-bromoacetamide, or N-bromophthalazone.

* * * * *